United States Patent [19]

Chandley

[11] Patent Number: 5,042,561

[45] Date of Patent: Aug. 27, 1991

[54] APPARATUS AND PROCESS FOR COUNTERGRAVITY CASTING OF METAL WITH AIR EXCLUSION

[75] Inventor: George D. Chandley, Amherst, N.H.

[73] Assignee: Hitchiner Manufacturing Co., Inc., Milford, N.H.

[21] Appl. No.: 428,198

[22] Filed: Oct. 27, 1989

Related U.S. Application Data

[63] Continuation-in-part of Ser. No. 175,231, Mar. 30, 1988, abandoned.

[51] Int. Cl.[5] ..... B22D 18/06

[52] U.S. Cl. ..... 164/63; 164/66.1; 164/119; 164/255; 164/259; 164/306

[58] Field of Search ..... 164/63, 66.1, 119, 255, 164/259, 306, 307

[56] References Cited

U.S. PATENT DOCUMENTS

| | | |
|---|---|---|
| 1,153,220 | 9/1915 | Grey . |
| 1,473,246 | 11/1923 | Montupet . |
| 2,379,401 | 6/1945 | Poulter . |
| 2,544,598 | 3/1951 | Kalina . |
| 2,923,040 | 2/1960 | Goodwin . |
| 2,991,518 | 7/1961 | Schaefer . |
| 3,376,915 | 4/1968 | Chandley . |
| 3,410,332 | 11/1968 | Woodburn et al. . |
| 3,441,078 | 4/1969 | Chandley . |
| 3,598,167 | 8/1971 | Snyderman . |
| 3,635,791 | 1/1972 | Bly et al. . |
| 3,754,592 | 8/1973 | Mullen . |
| 3,774,668 | 11/1973 | Heimgartner . |
| 3,862,656 | 1/1975 | Weiler et al. . |
| 3,863,706 | 2/1975 | Chandley et al. . |
| 3,900,064 | 8/1975 | Chandley et al. . |
| 3,926,245 | 12/1975 | Kanaby . |
| 3,955,561 | 5/1976 | Schultheiss . |
| 4,027,719 | 6/1977 | Strempel . |
| 4,090,550 | 5/1978 | Szakacs et al. . |
| 4,112,997 | 9/1978 | Chandley . |
| 4,129,164 | 1/1977 | Torikai . |
| 4,355,680 | 10/1982 | Frantzreb . |
| 4,374,799 | 2/1983 | le Clerc de Bussy . |
| 4,512,383 | 4/1985 | Suzuki et al. . |
| 4,550,763 | 11/1985 | Nikolov . |
| 4,589,466 | 5/1986 | Chandley et al. . |
| 4,791,977 | 12/1988 | Chandley . |

FOREIGN PATENT DOCUMENTS

| | | |
|---|---|---|
| 58-20369 | 2/1983 | Japan . |
| 60-154861 | 8/1985 | Japan . |

*Primary Examiner*—Kuang Y. Lin

[57] ABSTRACT

A method and apparatus for countergravity casting of molten metal with exclusion of air in a gas-pervious mold sealed in an evacuable chamber having a free end of a fill pipe for the mold cavities projecting therefrom. The fill pipe is moved relative to an enclosed crucible containing the molten metal under an air-free atmosphere of inert gas to project the fill pipe free end into the crucible enclosure to a position below the molten metal so that evacuation of the chamber produces filling of the mold. Entry of air into the crucible enclosure is prevented by maintaining the surface of the molten metal and the ambient atmosphere a sufficient distance apart prior to insertion of the fill pipe to prevent circulating air currents from drawing air down to the metal or by blocking entry into the crucible enclosure. Entry of air can be further prevented by maintaining a sufficient pressure of inert gas in the crucible enclosure and by sealing the upper portion of the fill pipe between the chamber and the mold.

31 Claims, 8 Drawing Sheets

APPARATUS AND PROCESS FOR COUNTERGRAVITY CASTING OF METAL WITH AIR EXCLUSION

This is a continuation-in-part of application U.S. Ser. No. 175,231 filed Mar. 30, 1988 entitled "Apparatus and Process for Countergravity Casting of Metal with Air Exclusion," now abandoned, and is related to an application of the same inventor U.S. Ser. No. 047,907, filed May 7, 1987, now U.S. Pat. No. 4,791,977, issued Dec. 20, 1988.

BACKGROUND OF THE INVENTION

This invention relates to methods and apparatus for countergravity casting of metals, particularly of reactive metals, such as certain alloys, containing elements which are reactive at casting temperatures with air to form oxides and/or nitrides, harmful to the cast product.

For good quality casting of such reactive metals, all casting operations, during which the metal is at a temperature at which it is reactive with air, should be conducted with air excluded, either by means of a vacuum or by air replacement with an inert gas. A method and apparatus in general use for countergravity casting with such air exclusion is disclosed in U.S. Pat. Nos. 3,863,706 and 3,900,064. According to these patents, an air-tight, evacuable compartment is mounted above an air-tight enclosure of a melting crucible for the metal, the compartment having access to the crucible through an air-tight conduit extending from the compartment through the top of the crucible enclosure, the conduit being provided with an intermediate closure slide valve. Thus, the crucible enclosure is not exposed to the ambient atmosphere. A vertically partable chamber within the compartment receives and is sealed around a pervious mold with the lower end of a fill pipe of the mold protruding from the chamber bottom.

In use of this patented apparatus as described in the patents, a supply of molten metal to be cast has been provided in the crucible by melting ingots thereof in the crucible with the crucible enclosure evacuated to a high vacuum. In casting, a mold is placed in the mold chamber inside the compartment, both chamber and compartment are sealed and evacuated, and they and the crucible enclosure are backfilled with inert gas such as argon to the same low vacuum. With the conduit valve open, the chamber is lowered through the conduit until the protruding end of the fill pipe of the mold is below the surface of the molten metal in the crucible. The chamber is then evacuated to a sufficiently high vacuum to cause the molten metal to flow through the fill passage to fill the mold cavities. After sufficient hardening of the metal in the mold cavities, the pressure is raised in the chamber and compartment, and the chamber is withdrawn from the crucible enclosure, into the compartment for removal of the mold from the chamber and compartment.

While the method and apparatus of these patents have been very successful in producing fine quality castings of air-reactive metals, the provision of the outer compartment around the mold chamber and its valved conduit connected to the crucible enclosure are expensive apparatus which complicate the operation and impose some undesirable restrictions on use. For example, the outer compartment needs sealable doors to provide access to the chamber within for inserting and removing the mold, hampering these operations. The compartment is exposed conductively to the heat of the crucible enclosure by the connecting conduit, and when the valve is open, is exposed to the heat within it, making it difficult to cool the compartment adequately. Location of the mechanism for lowering or raising the chamber in part within the compartment involves complexity of sealing the compartment about movable members extending into it, as well as prohibiting access to the mechanism and the mold while the compartment is sealed.

Other prior art, though avoiding the complex apparatus described above, fails to effectively contain the inert atmosphere within the crucible containing the molten metal.

In the inventor's related application of U.S. Pat. No. 4,791,977, the inventor attempted to prevent air contamination by maintaining the inert gas pressure in the crucible enclosure holding the melt above atmospheric pressure while the crucible enclosure was exposed to the ambient atmosphere. It was thought that the heated inert gas rising through the small opening in the crucible enclosure designed to accommodate the fill pipe would be sufficient to prevent air from passing through the opening and contacting the melt. Subsequently the inventor determined, however, that air contamination still occurred with highly reactive metals. It appeared upon investigation that the source of the problem was vertical thermal air currents or vortices circulating above the molten metal that drew air downward through rising inert gas to the crucible and into contact with the molten metal. These air currents were heretofore known in fluid mechanics as "Brillion zones".

BRIEF DESCRIPTION OF THE INVENTION

The present invention makes it possible to eliminate the compartment for the mold chamber, and its valved conduit connection to the crucible enclosure of apparatus such as disclosed in the aforesaid U.S. patents while maintaining an effective inert atmosphere at the surface of the molten metal.

In one aspect, this substantial improvement was made possible in part by the conception of a novel apparatus in which means are provided for spacing the upper surface of the molten metal at a distance from a source of ambient atmosphere beyond the opening sufficient to prevent the Brillion zones from drawing air down to the metal and maintaining the metal surface at this distance except during filling of the mold. The preferred distance between the upper metal surface and ambient atmosphere is at least 8 inches. It has been found that this distance prevents contamination due to Brillion zones at practical inert gas pressures.

The spacing function may be accomplished by means of a flexible, reversibly compressible shield positioned between the crucible enclosure opening and the opening in the evacuable chamber through which the free end of the fill pipe projects. As the fill pipe is inserted into the crucible enclosure below the molten metal surface, the shield compresses. Once the mold cavities have been filled, the fill pipe is withdrawn through the crucible enclosure opening, whereupon the shield reverts to its original shape.

The spacing function may also be accomplished by means of a movable member that forms part of the crucible enclosure which also compresses when the fill pipe free end is projected into the crucible enclosure; preferably, compression occurs when the top wall of the crucible enclosure contacts the bottom wall of the evacuable chamber containing the mold. Once casting is complete and the fill pipe is withdrawn, this member returns to its original position.

In another aspect, contamination of the melt is prevented as follows. The crucible enclosure is provided with a first cover having an opening adapted to receive a metal charge and the free end of the fill pipe, and a second, laterally movable cover with first and second openings laterally spaced from each other, and an uninterrupted portion at least equal to the diameter of the opening in the first cover. The first opening of the laterally movable cover is adapted to receive a metal charge and the second opening adapted to receive the free end of the fill pipe. The first opening of the movable cover and the opening in the first cover are aligned with and in communication with each other and the ambient atmosphere during filling of the crucible with metal while maintaining a flow of inert gas through the crucible enclosure to prevent air contamination. After the crucible has been charged, the movable cover is positioned to prevent air from contacting the molten metal. During casting, the lower end of the fill pipe is inserted into the second opening of the movable cover and the movable cover then moved (by moving the fill pipe) to align the fill pipe with the opening in the first cover. The free end of the fill pipe is then projected into the molten metal, after which the movable cover is positioned to prevent air from contacting the molten metal.

In one preferred embodiment, air contamination of the melt is prevented by establishing a substantially air free atmosphere of inert gas in the crucible enclosure and then inserting into the first opening in the movable cover a pipe adapted to space the upper surface of the metal in the crucible at a distance from the ambient atmosphere sufficient to prevent circulating air currents from drawing air through the first opening and the opening in the first cover down to the metal when the first opening and the opening in the first cover are aligned and in communication with each other and the ambient atmosphere. The movable cover is then moved to align the pipe, the first opening in the movable cover, and the opening in the first cover with each other while maintaining a flow of inert gas through said crucible enclosure. If desired, metal can then be charged to the crucible through the pipe, the first opening in the movable cover, and the opening in the first cover.

In another preferred embodiment, air contamination is prevented by positioning the movable cover to block the opening in the first cover leading to the molten metal while maintaining the crucible enclosure under a substantially air-free atmosphere of inert gas.

In each of the above aspects, the mold chamber during the insertion process preferably is evacuated to create a lower pressure in the mold interior than the pressure of inert gas in the crucible enclosure.

One advantage of this apparatus and process is that casting can be conducted without the complex sealed enclosures thereof of the prior art. For this purpose, the fill pipe has a gas impervious surface, and a sufficient pressure of inert gas is maintained in the crucible enclosure to prevent access of air to the interior of the crucible enclosure through the opening therein from a source of air therebeyond. Preferably, the inert gas pressure is slightly above atmospheric pressure. Consequent losses of the inert gas to atmosphere through the opening are minimal if the inert gas is argon (density greater than air) or nitrogen (density slightly less than air) or other gas having a density at least approximately as great as that of nitrogen under the same conditions.

Not only is complexity of prior art apparatus eliminated in this way, but also it becomes possible, with a fill pipe of suitable length, to maintain the mold chamber spaced from the crucible enclosure and thermally insulated therefrom by atmospheric air or inert gas, enabling more effective and less expensive cooling of the chamber. In addition, the fill pipe is accessible during casting operations for operations thereon, such as crimping it closed in accordance with U.S. Pat. No. 4,589,466 for example.

A further advantage, useful in molding large parts, is that the amount of time necessary to pump down the system and fill it with inert gas is decreased.

In one preferred process and apparatus a removable vacuum lid having a charging lock is provided which is sealable to the crucible enclosure and capable of withstanding evacuation of the enclosure to high vacuum. For supplying molten metal to the crucible, a metal ingot is inserted through the charging lock into the crucible. After the metal is melted under vacuum, the enclosure is backfilled with inert gas and the vacuum lid is removed in preparation for casting.

In a second preferred process and apparatus a removable cover is provided for the opening in the crucible housing which is sealable to the enclosure about the housing. This cover, which is removed before, and replaced after, the casting operations, can closely fit the opening and be relatively light and easily hand manipulated, since it is not required to withstand evacuation of the enclosure. For melting a new supply of ingot of the metal under high vacuum, another larger, heavier imperforate cover is provided, also to the enclosure about the opening and which may be manipulated by mechanical hoist. After the metal is melted under vacuum and the enclosure is backfilled with inert gas, the larger cover is replaced by the smaller cover.

Additional inert gas to that from the crucible enclosure can be supplied to the mold chamber to aid the flushing operations and/or to raise the pressure in the chamber thereafter. The advantages of an evacuating connection to the mold in accordance with the aforesaid U.S. Pat. No. 4,791,977 are also utilized.

DESCRIPTION OF THE PREFERRED EMBODIMENTS

Figure 1:
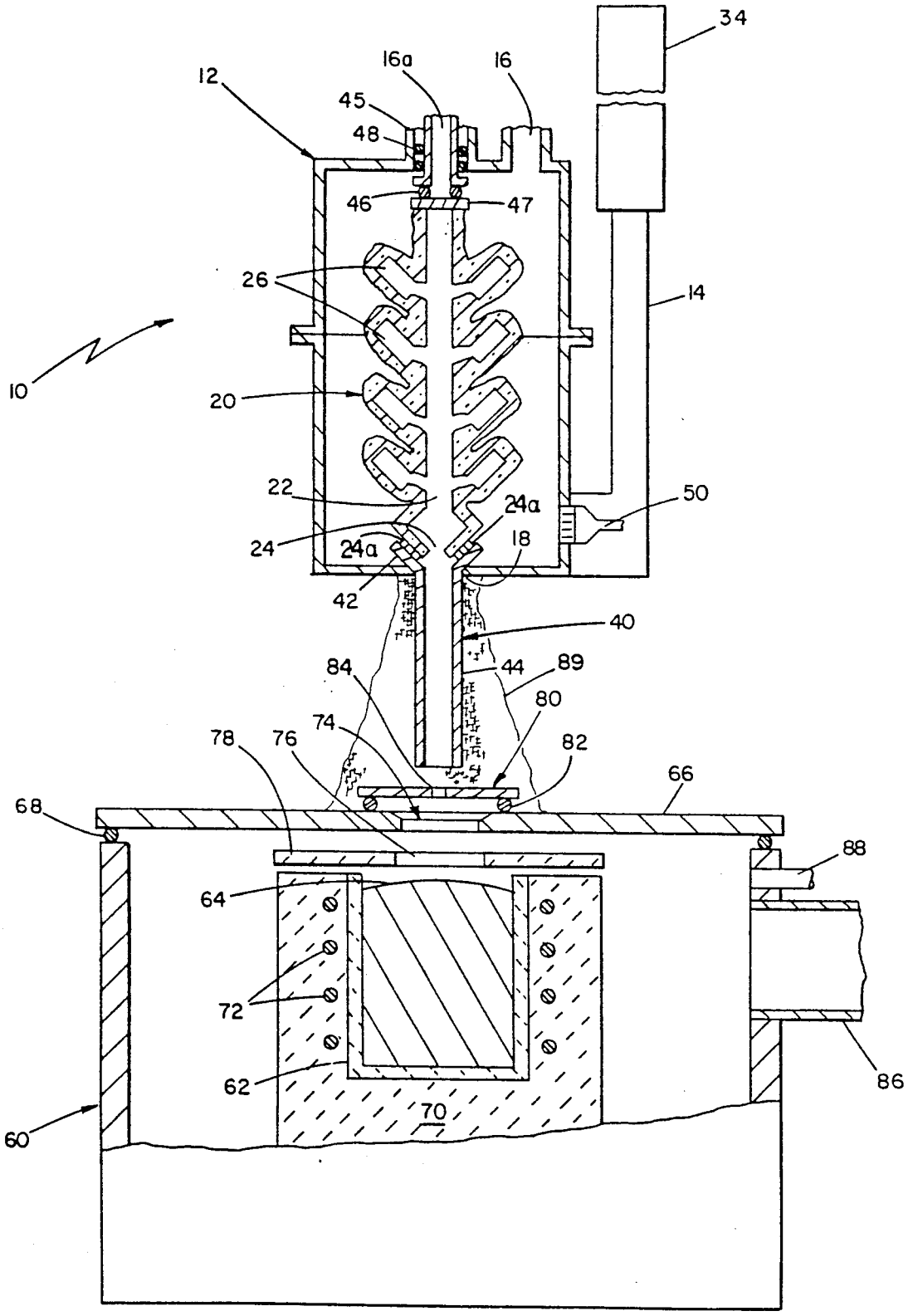
FIGS. 1 and 2 are schematic side views of one preferred apparatus of the invention, illustrating successive steps in the operation of the methods of the invention.

Referring to FIG. 1, a crucible 62 for molten molding metal having an upper surface 64 is enclosed in a generally box-like structure, designated generally 60. Enclosure 60 may rest on the floor and may have its top wall 66 removably seated on the tops of the side walls by an O-ring seal 68 (for complete access to the interior). The inside of the walls of enclosure 60 may be provided with a coil or coils (not shown) for the circulation of cooling fluid such as water or double walls may be provided, spaced apart to permit circulation of coolant between them. Crucible 62 is embedded in a block of refractory electrical insulation 70, containing induction heating coil 72 surrounding the crucible.

An opening 74 is provided in the top wall 66 of enclosure 60, centrally of molten metal surface 64 of crucible 62, this opening being of a size to receive freely therethrough the lower end 44 of fill pipe 40 of evacuable molding apparatus 10. A like opening 76 is provided in the usual heat shield 78 of insulating material which is supported above the crucible on the top of block 70. A removable cover 80 for opening 74 is sealed to top wall 66 of the enclosure about opening 74 by O-ring seal 82. A small opening 84 may be provided centrally of cover 80 through which a thermocouple may be inserted in the melt to measure its temperature. Enclosure 60 has a connection 86 to a differential pressure apparatus (not shown) capable of evacuating crucible enclosure 60 to a high vacuum when the enclosure is sealed. A connection 88 is also provided to a source of inert gas (not shown).

An advantage of the apparatus so far described in that it is suitable for air-free casting in conjunction with the simplified casting apparatus of U.S. Pat. No. 4,589,466. However, it is preferred to use the improvement thereof, which is the subject of aforesaid related U.S. Pat. No. 4,791,977 and which is shown in the drawings hereof. The disclosure of said application, insofar as not so expressly incorporated herein is incorporated by reference.

Molding apparatus 10 has a partable sealable loading chamber 12 mounted on a vertically movable support 14. Chamber 12 is made in two parts sealed together when closed as by an O-ring (not shown), and is opened and closed in the vertical direction by suitable apparatus (not shown). Chamber 12 has, in its lower mold supporting wall, a central opening 18 for supporting a gas permeable mold, generally designated 20 and shown here as a shell-type mold, having a vertical fill passage 22 with a lower end 24 for introducing molten metal into mold cavities 26 therein. In its upper wall, chamber 12 has a connection 16 to differential pressure apparatus (not shown).

There is provided an impervious fill pipe 40 having an upper flared portion providing a radially outwardly extending upper flange 42 with a lower portion 44 extending vertically down from it. Upper flange 42 is sealingly interposed between the lower mold supporting wall of chamber 12 and the lower end of mold 20 around its opening 24 by means of seal 24*a*. Lower portion 44 extends through central opening 18 of chamber 12 and vertically downwardly therefrom. A hydraulic power cylinder 34 connected to movable support 14 is provided for relatively moving crucible 62 and chamber 12 with mold 20 toward and away from one another by selectively raising or lowering chamber 12 with mold 20. Although it is not shown in the drawings, each of the partable halves of the mold chamber 12 may have means for cooling the interior, such as a surrounding coil, or circulation space between double walls connected to a source of coolant which may be water.

The differential pressure apparatus can be selectively operated to apply through a connection 16*a* to differential pressure apparatus (not shown) a lower pressure to the interior of mold 20 than is simultaneously provided in chamber 12 through connection 16. Preferably, porous plug, 47, highly permeable to gas but not to metal, covers an opening at the top of mold 20 over fill passage 22 and the mouth of connection 16*a* is sealed to the mold top over plug 47 by sealing means 46, permitting porous plug 47 and the mold interior beneath it to be selectively exposed to a lower pressure through connection 16*a* than is provided in chamber 12. Sealing means 48 prevents leakage between duct 45 and chamber 12. Connections 16 and 16*a* may be to different vacuum pumping systems or to a single such system equipped with suitable valve controls for providing different pressures in the two connections.

A flexible, reversibly compressible, conically shaped shield 89 is positioned between top walls 66 and molding apparatus 10. The shield is woven from fibers of a refractory material in order to withstand the heat. Preferred materials for shield 89 include Refrasil TM, which is commercially available from Niantic Rubber Co., Cranston, R.I. The distance between molten metal surface 64 and the top of shield 89 located at central opening 18 of molding apparatus 10 is at least 8 inches. With this arrangement, the nearest source of air that could contaminate the molten metal when cover 80 is removed is through the top of shield at opening 18, located relatively far away from the melt. Thus, cover 80 can be removed using a wire (not shown), while purging enclosure 60 with argon. The argon purge is at higher than atmospheric pressure, causing the argon to fill shield 89 and to pass through the pores thereof to exclude air from passing through the shield. Therefore, the spacing of the melt surface from the only source of air (18) prevents circulating currents (Brillion zones) from drawing air through opening 74 into the melt.

In casting with the method and apparatus of the invention, a supply of molten metal is provided in crucible 62 under a substantially air-free atmosphere of inert gas (in a manner hereinafter described). Chamber 12 is positioned with fill pipe end 44 centered over crucible enclosure opening 74, as shown in FIG. 1, and cover 80 is removed before the casting operation commences. By sealing upper flange 42 of fill pipe 40 between the lower wall of chamber 12 and the lower end of mold 20 around opening 24 and using shield 89 coupled with maintaining the inert gas pressure in enclosure 60 above atmospheric, entrance of air into the crucible enclosure through opening 74 is prevented. With an inert gas such as argon, several times as dense as air, or nitrogen, with a density only fractionally lower than air, the gas flow may be easily controlled to preclude air entry into enclosure 60 through opening 74.

Figure 2:
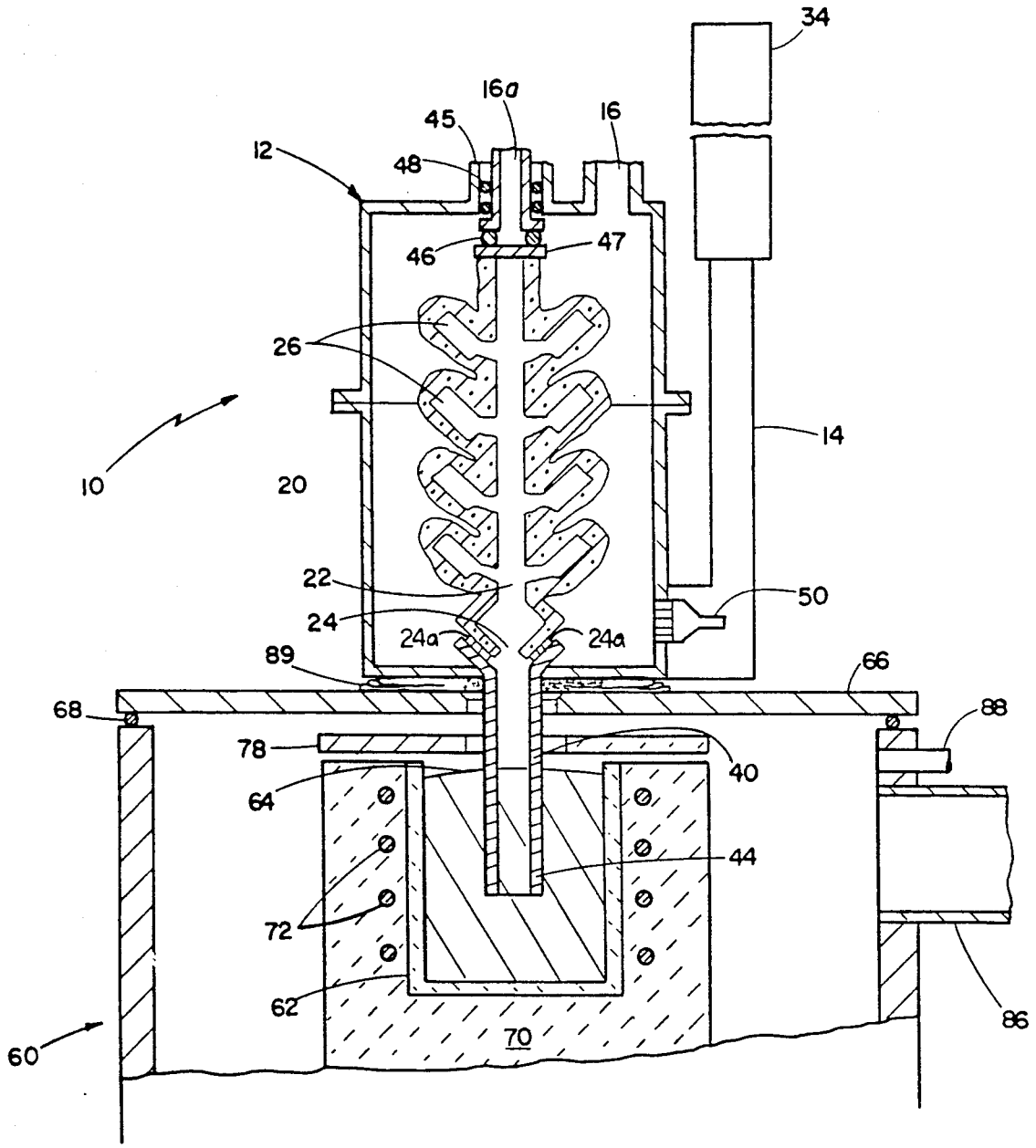

In casting, chamber 12 is moved by operating power cylinder 34 providing the relative motion of the fill pipe 40 and the crucible enclosure 60 to move the fill pipe through opening 74 in the enclosure. Referring to FIG. 2, the fill pipe end 44 is inserted through opening 74 and immersed into the molten metal below its surface. The relative motion of fill pipe end 44 and crucible enclosure 60 causes shield 89 to compress to a small, relatively flat shape. In accordance with the method of the aforesaid related U.S. Pat. No. 4,791,977, as fill pipe end 44 and crucible enclosure 60 are moved towards each other, reduced differential pressure is applied to the interior of mold 20 through vertical passage 22 by operating connection 16*a* to cause argon and then molten metal to flow up fill pipe 40 and fill vertical passage 22, the metallostatic head in vertical passage 22 also causing lateral flow into mold cavities 20. Simultaneously, a second pressure equal to or higher than the pressure applied through connection 16*a*, but lower than the pressure on the molten metal in crucible 30, is applied to chamber 12, and so to the exteior of mold 20, through connection 16, to insure that the mold cavities 26 fill with molten metal. The magnitude of this second pressure is just adequate to cause the mold cavities 26 to fill. Once filling is complete, the pressure surrounding mold 20 may be increased, while maintaining the low pressure in the mold interior, to improve part quality and reduce tensile stresses in the mold. The pressure will be raised in chamber 12 by admission of inert gas through connection 50 so long as the casting metal remains at reactive temperature.

Once molding is complete, the aforementioned pressures are restored to atmospheric pressure. Chamber 12 is then opened and the filled mold 20 and fill pipe 40 are removed in preparation for another molding cycle. Shield 89, because it is reversibly compressible, returns to its original shape. Cover 80 is then replaced over opening 74 in enclosure 60 before casting the next mold.

The use of connection 16*a* and the method of its operation just described are preferred but not essential. With connection 16*a* omitted, the method as described is changed only in that the low pressure to cause the filling of the mold cavities is produced entirely in chamber 12 through connection 16, the external low pressures on the mold being transmitted to its interior through its porous body. The results are generally not as satisfactory as with the two vacuum connections operated at differential. Impurities are not removed from the mold system as effectively during filling of the mold cavities, and the external pressure on the mold to obtain adequate filling needs to be lower, with resulting greater load of the metal weight on the mold. However, the method and apparatus are markedly beneficial, as compared with the prior art, without connection 16*a*.

Figure 3:
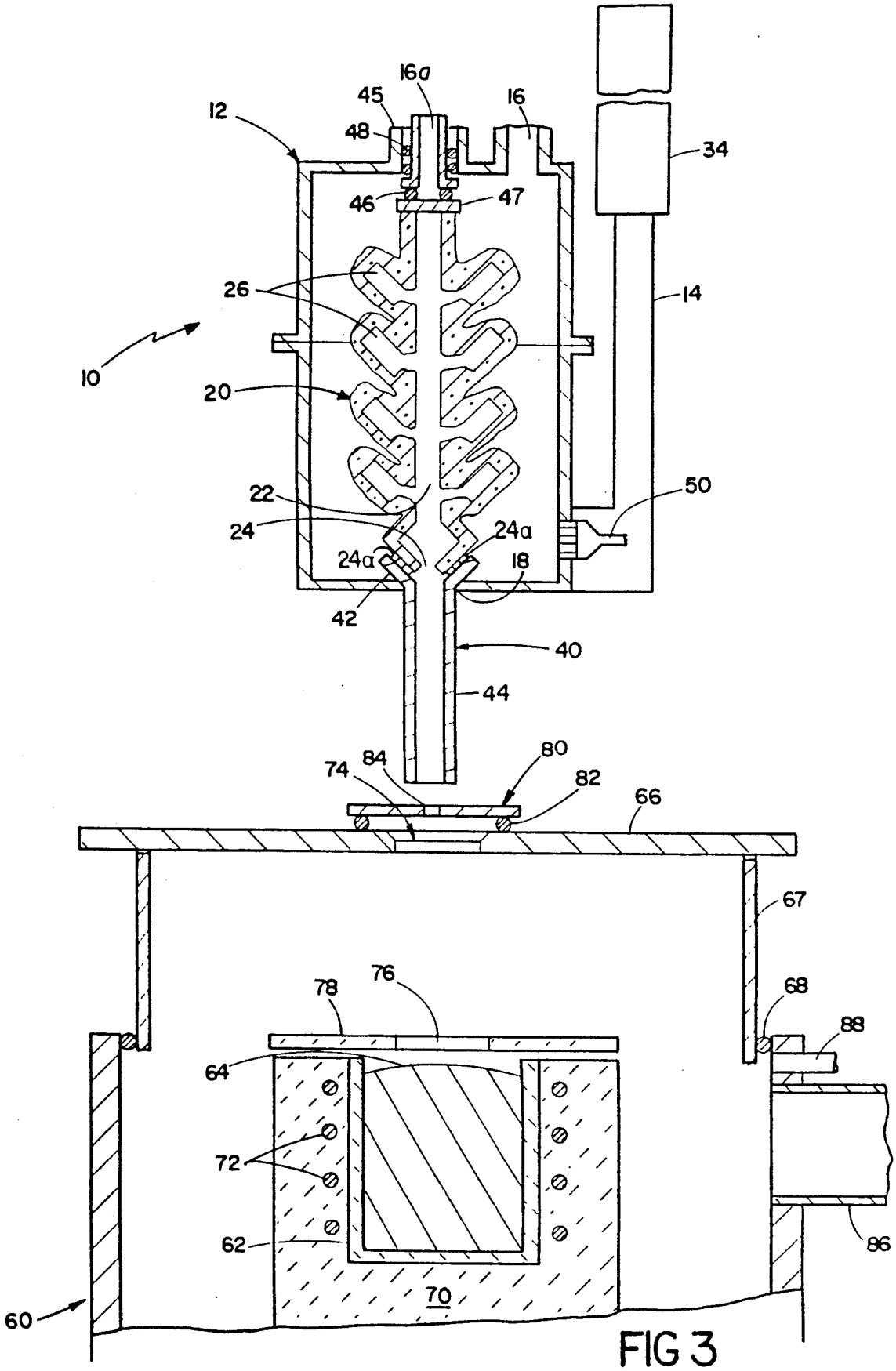
FIGS. 3 and 4 are schematic sectional side views of another preferred apparatus of the invention, also illustrating succesive operational steps.
Figure 4:
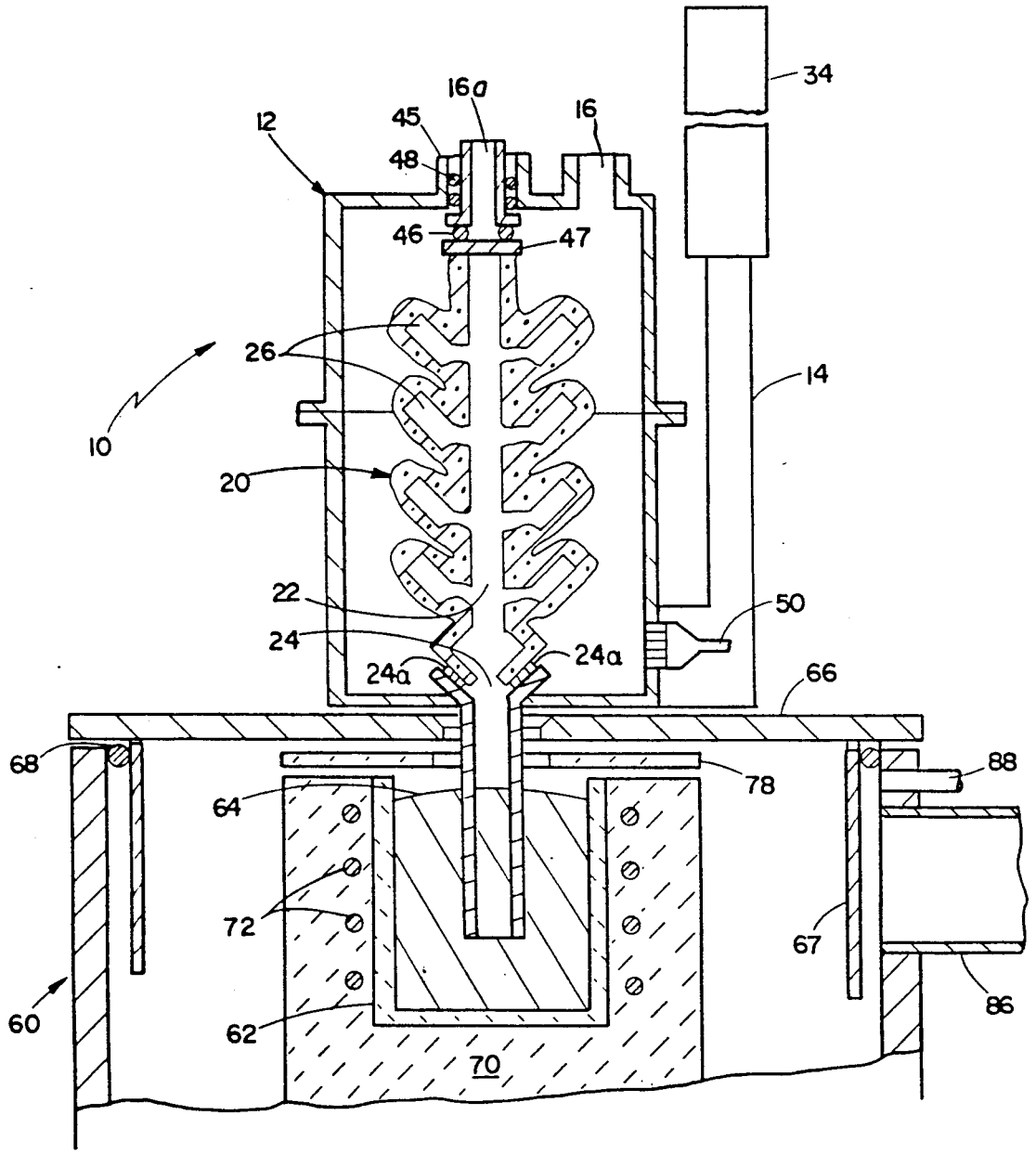

Referring to FIG. 3, there is shown another way of protecting the molten metal from air contamination. Crucible enclosure 60 is provided with a movable portion 67 supported by hydraulic cylinders (not shown) that spaces metal surface 64 from opening 74 (the nearest source of air) and maintains that spacing at about 8 inches or more. At this distance, contamination due to circulating air currents is prevented when cover 80 is removed under flowing argon. As shown in FIG. 4, during casting when the bottom portion of apparatus 10 through which fill pipe 40 projects contacts the top wall 66 of crucible enclosure 60 as fill pipe 40 and crucible enclosure 60 are moved relatively towards each other, movable portion 67 is engaged and compressed. Once casting is complete and fill pipe 40 is withdrawn, movable portion 67 is returned to its original position. The engagement of the bottom of apparatus 10 and wall 66 seals opening 74 to prevent any significant air intrusion as movable portion 67 is compressed and later returned to its original position after mold filling.

Figure 5:
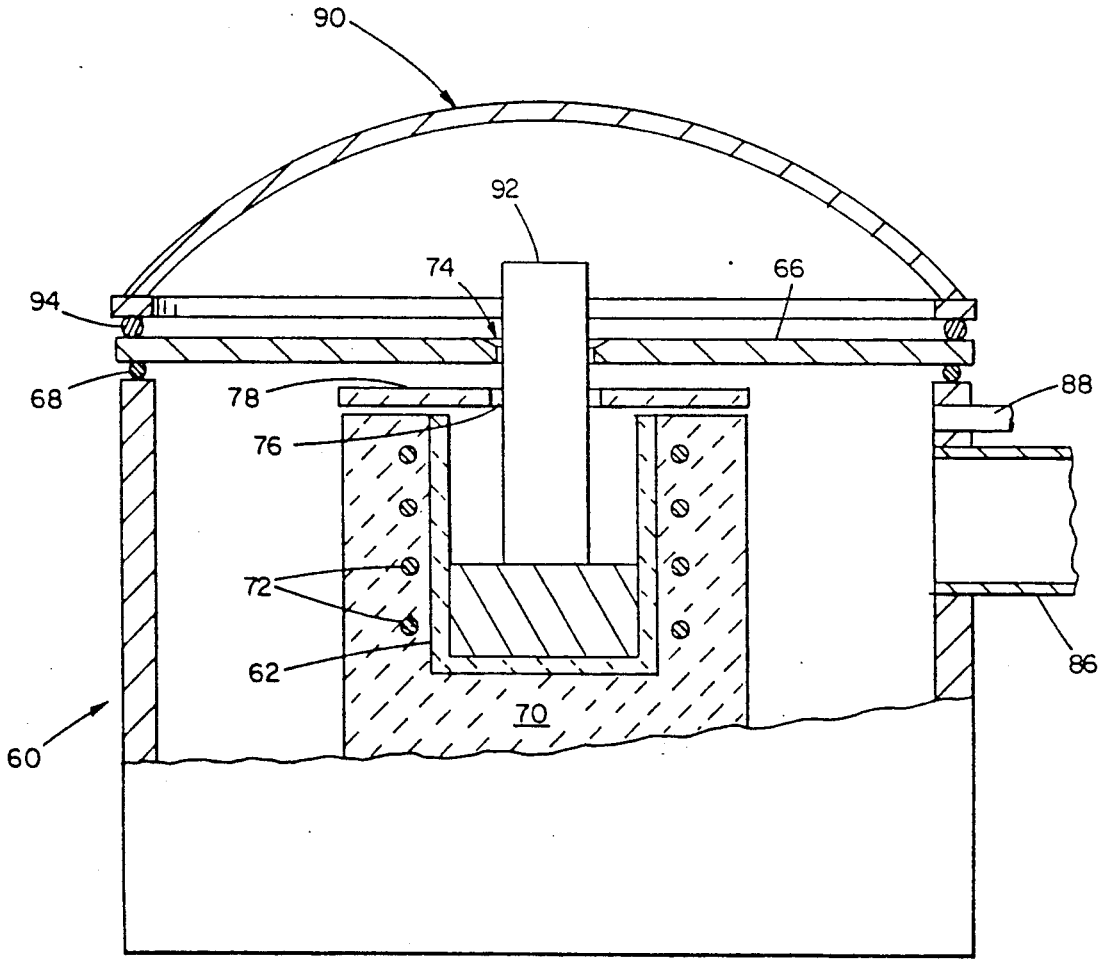
FIG. 5 is a similar view of the apparatus illustrating the addition of metal to the crucible.

Referring to FIG. 5, for initially supplying metal to the crucible under an air-free inert gas atmosphere, which needs to be done only occasionally, a replacement cover 90 is provided which is impervious, larger and stronger than the cover 80, and capable of withstanding the evacuation of crucible enclosure 60 to high vacuum. With cover 80 removed, and the mold chamber 12 and its fill pipe 40 of FIG. 1 (not shown) moved out of the way, an ingot 92 of the metal to be melted is placed in the crucible through openings 74 and 76, and replacement cover 90 is removably sealed to top wall 66 of the enclosure by an O-ring 94 and covers opening 74. The enclosure is evacuated through connection 86 to a substantially air-free condition, and induction coil 72 is operated to melt the ingot. When the melt has reached the desired temperature, the inert gas to the desired pressure is admitted to the enclosure through connection 88, cover 80 is reapplied using a manipulating rod (not shown), and the replacement cover 90 is removed. Since cover 90 seats on the periphery of, and covers, removable top wall 66 of enclosure 60, wall 66 is not exposed to the pressure differential of atmosphere on one surface and high vacuum on the other and, like cover 80, may be made lighter and easier to manipulate than the cover 90.

Figure 6:
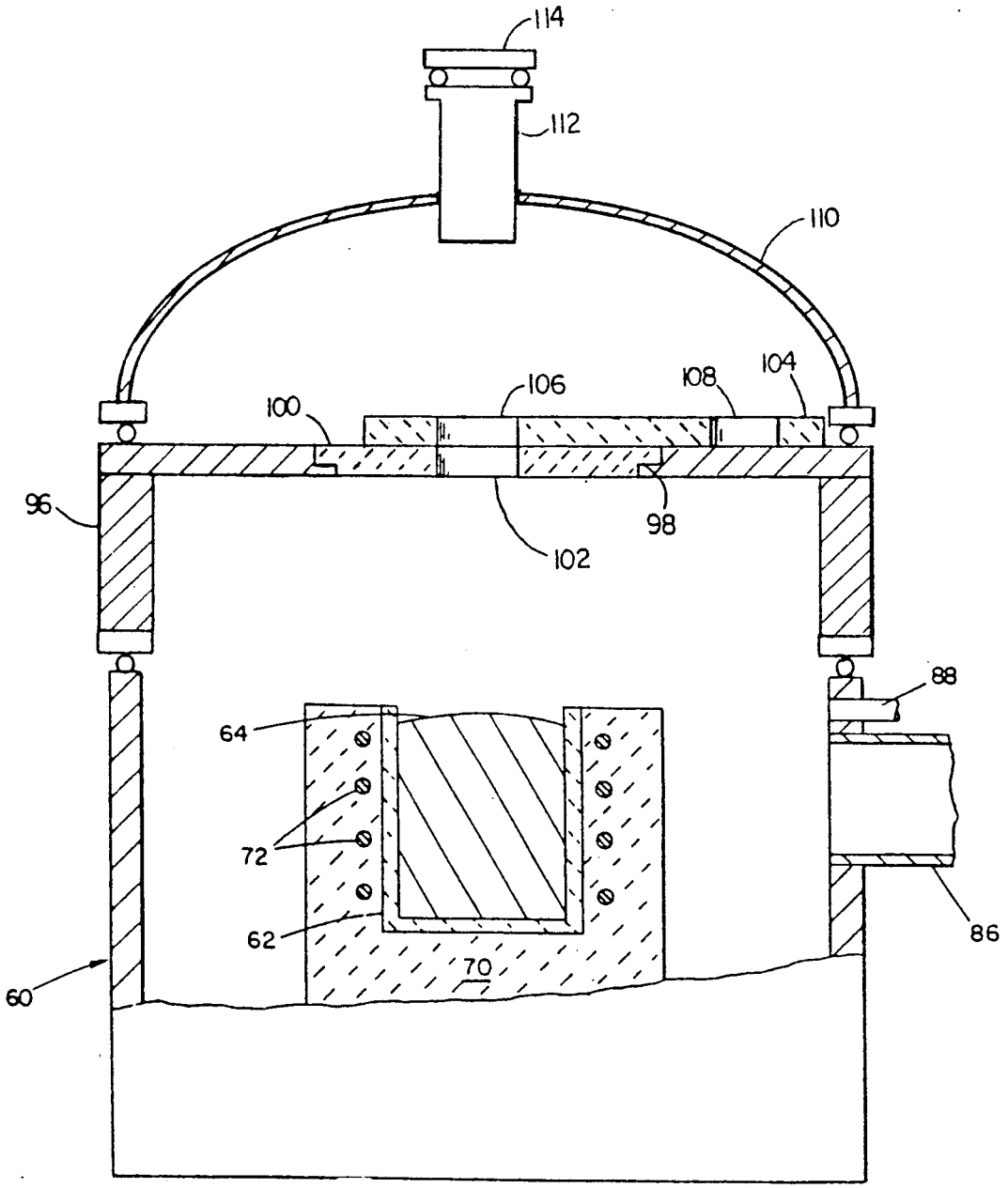
FIGS. 6 and 7 are schematic sectional side views of another preferred apparatus of the invention, also illustrating successive operational steps.

Referring to FIG. 6, there is shown another way of protecting the molten metal from air contamination. Crucible enclosure 60 is provided with a removable cover 96. Removable cover 96 features an opening 98 in which a cover 100 (which may be made of a gas-permeable refractory fiber board material) rests. Cover 100 has an opening 102 sized to accommodate a metal ingot approximately 3 inches in diameter and to receive freely therethrough the lower end 44 of fill pipe 40 of evacuable molding apparatus 10, shown in FIGS. 7 and 8.

A movable cover 104 rests atop cover 100. Cover 104 features openings 106 and 108. The diameter of opening 106 is approximately the same as that of opening 102 because it also must accommodate a 3 inch metal ingot during charging of crucible 62. Opening 108 is smaller because (as will be explained below) it need only accommodate the lower end 44 of fill pipe 40 of molding apparatus 10 which has a diameter of about $1\frac{1}{2}$ to $1\frac{3}{4}$ inches. Cover 104, which is made of a suitable gas-permeable or non-gas permeable refractory material such as heat resistant glass, can be moved sideways across cover 100 to block off opening 102; thus, the spacing between openings 106 and 108 is at least equal to the diameter of opening 102.

A cooled vacuum-containing lid 110 having a charging lock 112 for receiving a metal ingot is placed over cover 96 during preparation of the melt, after which it is removed to permit casting. A vacuum seal top 114 is placed over charging lock 112 during the melting operation.

In casting, a supply of molten metal is provided in crucible 62 under a substantially air-free atmosphere of inert gas as follows. With vacuum lid 110 in place, as shown in FIG. 6, a metal ingot is introduced into crucible 62 through charging lock 112 and through openings 102, 106. Vacuum seal 114 is then applied to lock 112 and the enclosure evacuated through connection 86 to a substantially air-free condition. Induction coil 72 is then operated to melt the ingot. If it is desirable to add more metal, the enclosure is back-filled with inert gas to a pressure of about 75 $\mu$m of Hg, and an inert gas flow is established to maintain this pressure and prevent air from coming in the top of charging lock 112. As long as the open end of lock 112 is well away from the ambient atmosphere (e.g., at least 8 inches), contamination due to circulating air currents (Brillion zones) drawing air through openings 102 and 106 into contact with the melt does not occur.

When the melt has reached the desired temperature, inert gas to the desired pressure is admitted to the enclosure through connection 88 and seal 114 is removed. Cover 104 is then moved laterally (while crucible enclosure 62 is under at atmosphere of inert gas) by means of a wire (not shown) to block off opening 102, and vacuum lid 110 is removed.

Figure 7:
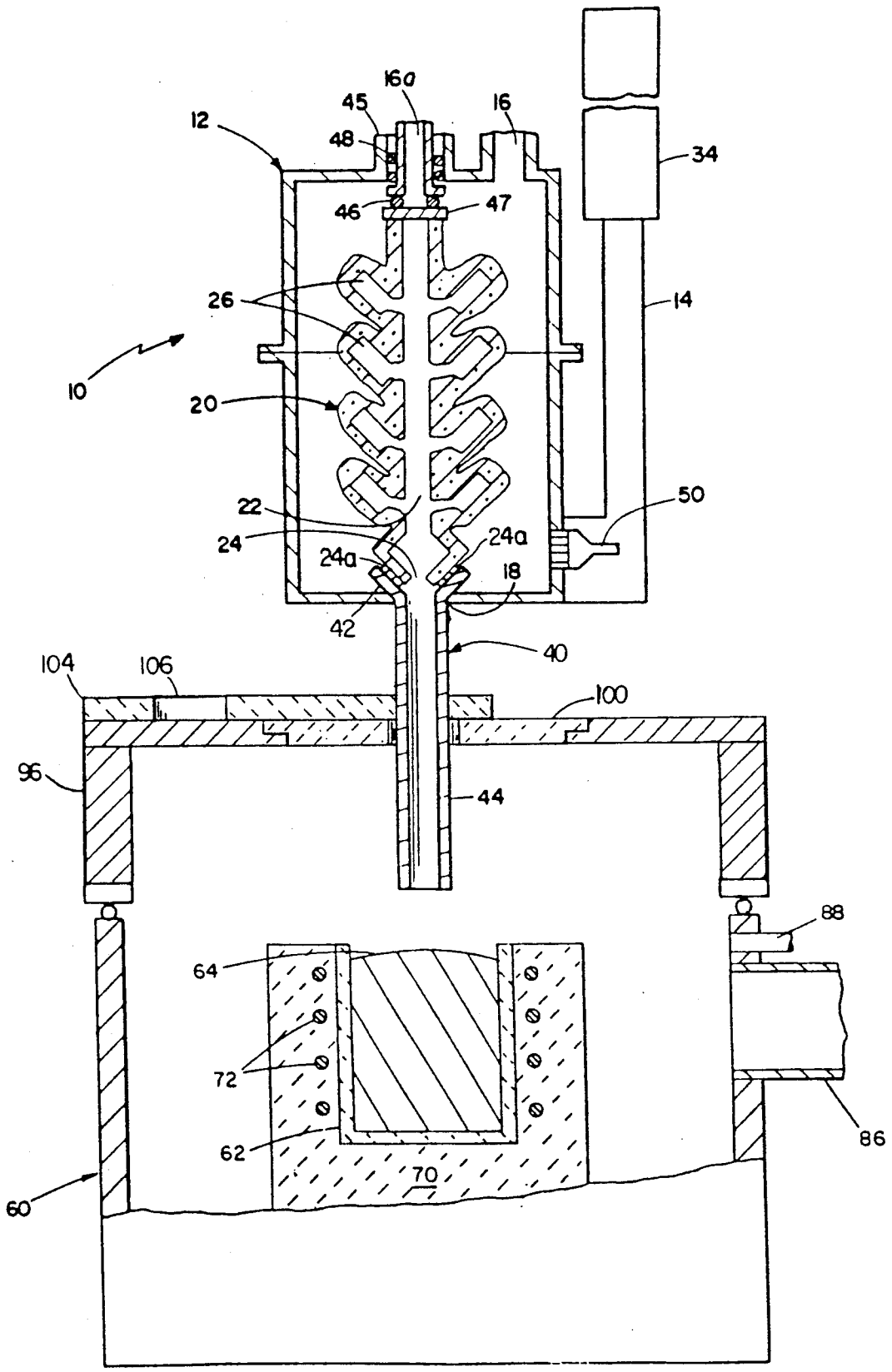
Figure 8:
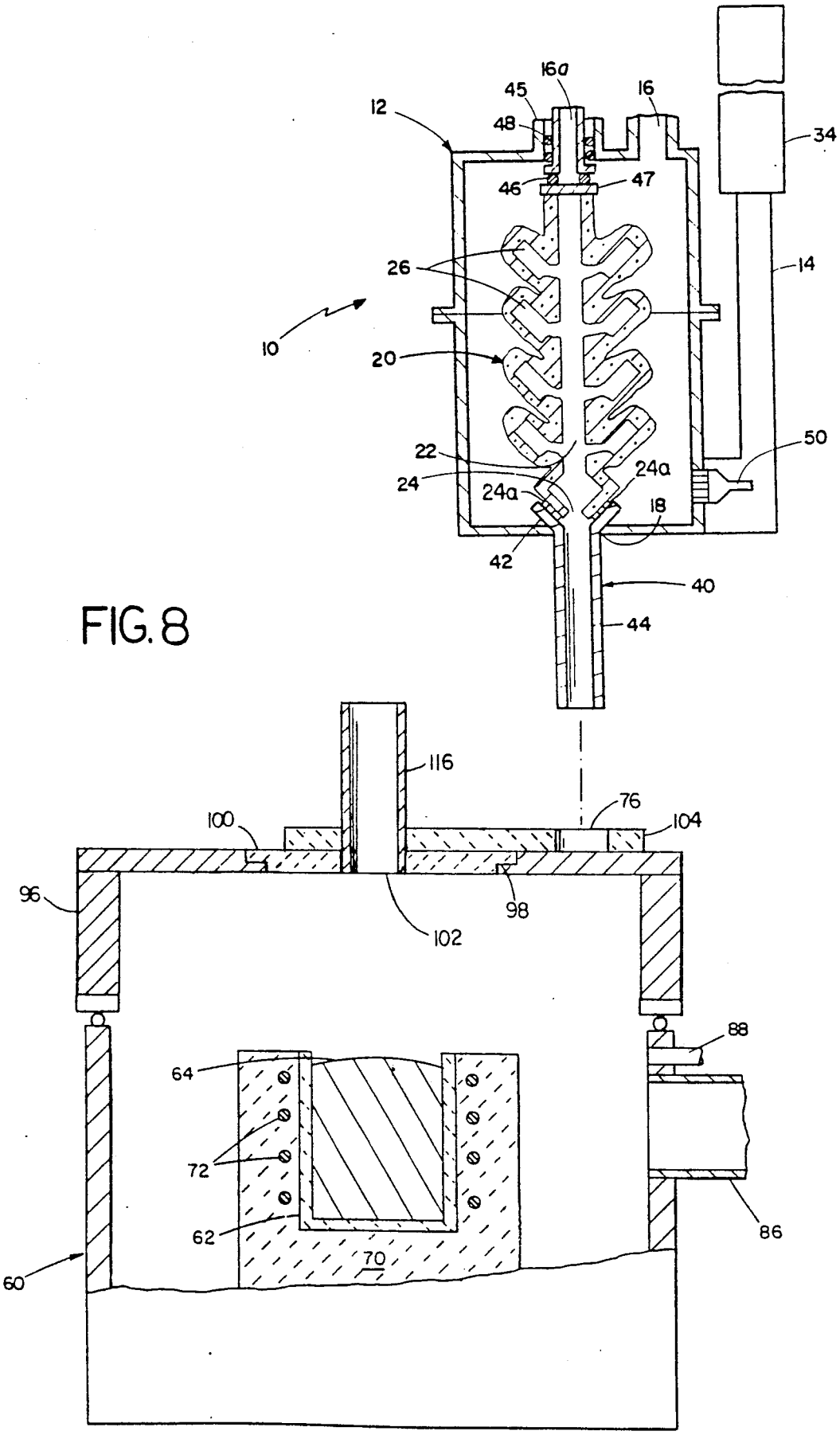
FIG. 8 is a similar view of the apparatus illustrating recharging of metal to the crucible.

Referring to FIG. 7, in casting, chamber 12 is moved by operating power cylinder 34 providing the relative motion of the fill pipe 40 and the crucible enclosure 60 to move the fill pipe into opening 108 in movable cover 104 (FIG. 8). Molding apparatus 10 and cover 104 are then moved laterally so that opening 108 is aligned with opening 102 in cover 100. The next step is to insert fill pipe end 44 through opening 102 below the surface of the molten metal. The mold is then filled as described previously.

Once molding is complete, the pressures achieved through connections 16 and **16*a* are restored to atmospheric pressure. Fill pipe 40 is then partially withdrawn such that it is removed from opening 102 while remaining in opening 108. Next, molding apparatus 10 and cover 104 are moved laterally so that opening 102 is again covered by cover 104, after which fill pipe 40 is completely withdrawn from opening 108. Chamber 12 is then opened and the filled mold 20 and fill pipe 40** are removed in preparation for another molding cycle.

Referring to FIG. 8, to recharge crucible 62 (which is still under an inert atmosphere) with additional metal in preparation for another molding cycle, it is not necessary to use vacuum lid 110. Instead, a flanged pipe 116 approximately 12 inches long is inserted into opening 106 of cover 104. Cover 104 is then moved laterally (either using a wire (not shown) or by re-inserting fill pipe 40 into opening 108) while maintaining an argon flow through crucible enclosure 62 sufficient to maintain an argon pressure of about 75 μm of Hg so that openings 106 and 102 are aligned. A metal charge is then inserted through pipe 116 and openings 106 and 102, and melted while under an inert gas atmosphere. Because pipe 116 maintains a sufficiently large distance (e.g., at least 8 inches) between the melt surface and ambient atmosphere, contamination of the melt due to circulating air currents (Brillion zones) is avoided.

The mold selected to illustrate the invention in the drawings is of the high temperature bonded, ceramic type for multiple parts. It will be understood, however, that this is merely illustrative and that other types of mold may be used, such as low temperature bonded sand molds, for single or multiple parts and of various sizes and shapes, the choices being increased when the low pressure connection **16*a*** is provided and used as described.

I claim:

1. A method of counter gravity casting of molten metal with the exclusion of air in a gas-pervious mold sealed in an evacuable chamber with a fill pipe for the mold cavities having a free end projecting therefrom, comprising the steps of:

providing a supply of the molten metal to be cast in a crucible in an enclosure under a substantially air free atmosphere of inert gas, said enclosure having an opening therein adapted to receive the free end of said fill pipe therethrough and said enclosure being exposed to a source of ambient atmosphere between said opening and said chamber;

providing a flexible, reversibly compressible shield between said crucible enclosure and the opening in said evacuable chamber through which said fill pipe projects to space the upper surface of said metal at a distance from the source of ambient atmosphere sufficient to prevent circulating air currents from drawing air through said opening down to said metal and to maintain said surface at said distance except during the filling of said mold;

relatively moving said fill pipe and said crucible enclosure to project the free end of said fill pipe through said crucible enclosure to a position below the surface of molten metal in said crucible while compressing and sealing said shield to said chamber, and evacuating said chamber to provide in the mold interior a pressure sufficiently lower than the pressure of said inert gas atmosphere in said crucible enclosure to cause molten metal to rise through said fill pipe to fill the cavities in said mold; and thereafter reversely relatively moving said mold fill pipe and crucible enclosure to withdraw said fill pipe through said opening and to restore said shield to its original shape.

2. A method of counter gravity casting of molten metal with the exclusion of air in a gas-pervious mold sealed in an evacuable chamber with a fill pipe for the mold cavities having a free end projecting therefrom, comprising the steps of:

providing a supply of the molten metal to be cast in a crucible in an enclosure under a substantially air free atmosphere of inert gas, said enclosure having an opening therein adapted to receive the free end of said fill pipe therethrough and said enclosure being exposed to a source of ambient atmosphere between said opening and said chamber;

providing said crucible enclosure with a movable member to space the upper surface of said metal at a distance from the source of ambient atmosphere sufficient to prevent circulating air currents from drawing air through said opening down to said metal and to maintain said surface at said distance except during the filling of said mold;

relatively moving said fill pipe and said crucible enclosure to project the free end of said fill pipe through said crucible enclosure to a position below the surface of molten metal in said crucible while compressing and sealing said movable member to said chamber, and evacuating said chamber to provide in the mold interior a pressure sufficiently lower than the pressure of said inert gas atmosphere in said crucible enclosure to cause molten metal to rise through said fill pipe to fill the cavities in said mold; and thereafter reversely relatively moving said mold fill pipe and crucible enclosure to withdraw said fill pipe through said opening and to restore said movable member to its original position.

3. A method according to claim 2 wherein said movable member compresses when the top wall of said crucible enclosure contacts the bottom wall of said evacuable chamber through which said fill pipe projects.

4. A method of counter gravity casting of molten metal with the exclusion of air in a gas-pervious mold sealed in an evacuable chamber with a fill pipe for the mold cavities having a free end projecting therefrom, comprising the steps of:

providing a supply of the molten metal to be cast in a crucible in an enclosure under a substantially air free atmosphere of inert gas, said enclosure being exposed to a source of ambient atmosphere, said enclosure having a first cover with an opening therein adapted to receive a metal charge and the free end of said fill pipe therethrough and a second, laterally movable cover placed atop said first cover with first and second openings spaced laterally from each other and an uninterrupted area greater than or equal to the diameter of said opening in said first cover, said first opening adapted to receive a metal charge and said second opening adapted to receive the free end of said fill pipe therethrough, said opening in said first cover and said first opening of said movable cover being aligned with and in communication with each other while providing said supply of molten metal to said crucible;

arranging said movable cover to prevent air from contacting the molten metal in said crucible;

inserting the free end of said fill pipe through said second opening in said movable cover and then moving said movable cover to align said free end of said fill pipe with said opening in said first cover;

relatively moving said fill pipe and said crucible enclosure to project the free end of said fill pipe to a position below the surface of molten metal in said crucible, and evacuating said chamber to provide in the mold interior a pressure sufficiently lower than the pressure of said inert gas atmosphere in said crucible enclosure to cause molten metal to rise through said fill pipe to fill the cavities in said mold;

reversely relatively moving said mold fill pipe and said crucible enclosure to withdraw said fill pipe from said molten metal; and arranging said movable cover to prevent air from contacting said molten metal.

5. The method of claim 4 wherein air is prevented from contacting said molten metal by establishing a substantially air free atmosphere of inert gas in said crucible enclosure;

inserting into said first opening in said movable cover a pipe adapted to space the upper surface of the metal in said crucible at a distance from the ambient atmosphere sufficient to prevent circulating air currents from drawing air through said first opening and the opening in said first cover down to said metal when said first opening and the opening in said first cover are aligned and in communication with each other and the ambient atmosphere and;

moving said movable cover to align said pipe, said first opening in said movable cover, and said opening in said first cover with each other while maintaining a flow of inert gas through said crucible enclosure.

6. A method according to claim 1, 2, or 5 wherein said distance between said upper surface of said metal and said ambient atmosphere is greater than 8 inches.

7. A method according to claim 5 further comprising charging metal to said crucible through said pipe, said first opening in said movable cover, and said opening in said first cover.

8. A method according to claim 4 wherein air is prevented from contacting the metal in said crucible by establishing a substantially air free atmosphere of inert gas in said crucible enclosure; and positioning said uninterrupted region of said movable cover over said opening in said first cover so as to block said opening in said first cover.

9. A method according to claim 1, 2, or 4 wherein said chamber is evacuated while said fill pipe and said crucible enclosure are being relatively moved towards each other to draw inert gas from said enclosure into said mold.

10. A method according to claim 1, 2, or 4 wherein the upper portion of said fill pipe is sealed between said chamber and said mold.

11. A method according to claim 1, 2, or 4, which includes providing a flow of inert gas into the chamber externally of said mold while said fill pipe free end is below the surface of molten metal in said crucible.

12. A method according to claim 11 which includes providing separate evacuating connectors to said chamber and to an upper part of a fill passage of said mold and thereby maintaining in said mold passage upper part a lower pressure than the pressure in the chamber externally of said mold during at least part of the time said fill pipe is below the surface of molten metal in said crucible.

13. A method according to claim 1, 2, or 4 wherein said fill pipe is impervious and which includes: exposing said fill pipe end and said crucible enclosure to atmosphere throughout said relatively moving steps and simultaneously maintaining a sufficient pressure of the inert gas in said crucible enclosure to prevent access of atmospheric air to the interior of said enclosure.

14. A method according to claim 13 wherein the pressure of inert gas maintained in said crucible enclosure is above atmospheric pressure.

15. A method according to claim 14 wherein said inert gas is at least approximately as dense as nitrogen.

16. A method according to claim 15 which includes thermally insulating said chamber from said crucible enclosure by atmospheric air or inert gas except for thermal communication by and through said fill pipe.

17. A method according to claim 1, or 2 which includes:

providing a first removable cover for said opening in said crucible enclosure;

removing said first cover from said opening;

inserting an ingot of said metal through said opening in said crucible enclosure into said crucible;

providing a second larger and imperforate removable cover for said opening, sealable pressure tight to said crucible enclosure about said opening, and of sufficient strength to withstand evacuation of said crucible enclosure to high vacuum;

applying said second cover, evacuating said crucible enclosure and second cover to a substantially air-free low pressure and heating said ingot to a molten condition suitable for casting;

providing a flow of inert gas into said crucible enclosure to produce said inert gas atmosphere therein, and;

removing said second cover and replacing it with said first cover.

18. A method according to claim 4 which includes providing a removable vacuum lid having a charging lock and sealable to said crucible enclosure and capable of withstanding evacuation of said enclosure to high vacuum;

inserting a metal ingot through said charging lock into said crucible and sealing said lock;

evacuating said crucible enclosure and vacuum lid to a substantially air-free low pressure and heating said ingot in said crucible to reduce said ingot to a molten condition suitable for casting;

providing a flow of inert gas into said crucible enclosure to produce said inert gas atmosphere therein;

laterally moving said movable cover so that it blocks said opening in said first cover to prevent air from contaminating said melt when said vacuum lid is removed; and removing said vacuum lid.

19. In apparatus for casting molten metal with the exclusion of air in a gas pervious mold sealed in an evacuable chamber with a fill pipe for the mold cavities having a free end projecting therefrom having enclosed crucible means for providing a supply of molten casting metal in a crucible under a substantially air-free atmosphere of inert gas, said crucible enclosure having an opening for receiving said fill pipe free end therethrough;

means for relatively moving said fill pipe and said crucible means to project said fill pipe free end into, and to withdraw it from, said crucible enclosure having an opening for receiving said fill pipe end therethrough: and means for evacuating said chamber to provide in the mold interior a pressure sufficiently below the pressure of said inert gas in said enclosure to cause molten metal to rise through said fill pipe to fill the cavities of said mold, the improvement wherein:

a flexible, reversibly compressible shield is provided between said crucible enclosure opening and the opening in said evacuable chamber through which said fill pipe free end projects that compresses and seals to said chamber when said fill pipe free end is projected into said crucible enclosure and regains its original shape after said fill pipe free end is withdrawn from said crucible enclosure to space the upper surface of said metal at a distance from a source of ambient atmosphere beyond said opening sufficient to prevent circulating air currents from drawing air through said opening down to said metal and maintaining said metal surface at said distance except during filling of said mold.

20. In apparatus for casting molten metal with the exclusion of air in a gas pervious mold sealed in an evacuable chamber with a fill pipe for the mold cavities having a free end projecting therefrom having enclosed crucible means for providing a supply of molten casting metal in a crucible under a substantially air-free atmosphere of inert gas, said crucible enclosure having an opening for receiving said fill pipe free end therethrough;

means for relatively moving said fill pipe and said crucible means to project said fill pipe free end into, and to withdraw it from, said crucible enclosure; and means for evacuating said chamber to provide in the mold interior a pressure sufficiently below the pressure of said inert gas in said enclosure to cause molten metal to rise through said fill pipe to fill the cavities of said mold, the improvement wherein:

said crucible enclosure is provided with a movable member that compresses and seals to said chamber when said fill pipe free end is projected into said crucible enclosure and returns to its original position after said fill pipe free end is withdrawn from said crucible enclosure to space the upper surface of said metal at a distance from a source of ambient atmosphere beyond said opening sufficient to prevent circulating air currents from drawing air through said opening down to said metal and maintaining said metal surface at said distance except during filling of said mold.

21. Apparatus according to claim 20 wherein said movable member compresses when the top wall of said crucible enclosure contacts the bottom wall of said evacuable chamber through which said fill pipe projects.

22. In apparatus for casting molten metal with the exclusion of air in a gas pervious mold sealed in an evacuable chamber with a fill pipe for the mold cavities having a free end projecting therefrom having enclosed crucible means for providing a supply of molten casting metal in a crucible under a substantially air-free atmosphere of inert gas;

means for relatively moving said fill pipe and said crucible means to project said fill pipe free end into, and to withdraw it from, said crucible enclosure having an opening for receiving said fill pipe free end therethrough; and means for evacuating said chamber to provide in the mold interior a pressure sufficiently below the pressure of said inert gas in said enclosure to cause molten metal to rise through said fill pipe to fill the cavities of said mold, the improvement wherein:

said crucible enclosure is provided with a first cover with an opening therein adapted to receive a metal charge and the free end of said fill pipe therethrough and a laterally movable cover placed atop said first cover with first and second openings spaced laterally from each other and an uninterrupted area greater than or equal to the diameter of said opening in said first cover, said first opening adapted to receive a metal charge and said second opening adapted to receive the free end of said fill pipe therethrough.

23. Apparatus according to claim 22 further comprising a pipe placed within said first opening of said movable cover adapted to space the upper surface of the metal in said crucible at a distance from the ambient atmosphere sufficient to prevent circulating air currents from drawing air through said opening down to the metal in said crucible when said first opening of said movable cover and the opening in said first cover are aligned and in communication with each other and the ambient atmosphere when providing a supply of molten metal to said crucible.

24. Apparatus according to claim 19, 20, or 23 wherein said distance between said upper surface of said metal and said ambient atmosphere is greater than 8 inches.

25. Apparatus according to claim 19, 20, or 22 wherein the upper portion of said fill pipe is sealed between said chamber and said mold.

26. Apparatus according to claim 19, 20, or 22, which includes means for supplying inert gas to said chamber externally of said mold.

27. Apparatus according to claim 19, 20, or 22 wherein said means for evacuating said chamber includes an evacuating connector to an upper part of a fill passage of a mold therein, and means for providing a lower pressure in said connector than in said chamber outside the mold.

28. Apparatus according to claim 19, 20, or 22 wherein said fill pipe is impervious and means is provided for supplying inert gas to said crucible enclosure at a rate to maintain a pressure of said gas in said enclosure sufficient to prevent access of atmospheric air or inert gas to the interior thereof.

29. Apparatus according to claim 19, 20, or 22 wherein said chamber is spaced sufficiently from said crucible enclosure as to be thermally insulated therefrom by atmospheric air except for thermal communication by and through said fill pipe.

30. Apparatus according, to claim 19, or 20 which includes a removable vacuum lid having a charging lock and sealable to said crucible enclosure and capable of withstanding evacuation of said enclosure to high vacuum.

31. Apparatus according to claim 22 which includes a removable vacuum lid having a charging lock and sealable to said crucible enclosure and capable of withstanding evacuation of said enclosure to high vacuum.

* * * * *